US008768212B2

(12) United States Patent
Hashimoto et al.

(10) Patent No.: US 8,768,212 B2
(45) Date of Patent: Jul. 1, 2014

(54) PROCESS UNIT AND IMAGE-FORMING DEVICE USING PROCESS UNIT

(75) Inventors: Junichi Hashimoto, Toyohashi (JP); Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 86 days.

(21) Appl. No.: 13/305,926

(22) Filed: Nov. 29, 2011

(65) Prior Publication Data

US 2012/0163859 A1 Jun. 28, 2012

(30) Foreign Application Priority Data

Dec. 24, 2010 (JP) ..... 2010-288711
Aug. 30, 2011 (JP) ..... 2011-186912

(51) Int. Cl.
*G03G 15/04* (2006.01)
*G03G 15/08* (2006.01)

(52) U.S. Cl.
CPC .... *G03G 15/0813* (2013.01); *G03G 2215/0636* (2013.01)
USPC ..... 399/119; 399/111

(58) Field of Classification Search
CPC ..... G03G 15/0813; G03G 15/0806; G03G 2215/0636
USPC ..... 399/111, 119
See application file for complete search history.

(56) References Cited

U.S. PATENT DOCUMENTS 4,873,553 A 10/1989 Inaba
5,832,343 A 11/1998 Kobayashi et al.
6,636,712 B2 10/2003 Shimaoka
7,110,688 B2 9/2006 Takahashi et al.
7,362,985 B2 4/2008 Okabe
7,920,807 B2 4/2011 Tomatsu
8,165,493 B2 4/2012 Chadani et al.
2002/0071693 A1* 6/2002 Shimaoka ..... 399/113
2004/0190932 A1* 9/2004 Ishii ..... 399/110
2005/0141909 A1 6/2005 Takahashi et al.

(Continued)

FOREIGN PATENT DOCUMENTS

CN 1763662 A 4/2006
CN 201170841 Y 12/2008

(Continued)

OTHER PUBLICATIONS

First Office Action issued in corresponding Chinese Patent Application No. 201110440852.9 mailed May 24, 2013.

(Continued)

*Primary Examiner* — Walter L Lindsay, Jr.
*Assistant Examiner* — Benjamin Schmitt
(74) *Attorney, Agent, or Firm* — Banner & Witcoff, Ltd.

(57) ABSTRACT

A process unit includes an image bearing member, a first frame, a developing unit, a pressing assembly, and a pressing-force adjusting assembly. The first frame supports the image bearing member. The developing unit includes a developing roller and a second frame supporting the developing roller. The pressing assembly generates a first pressing force acting on the developing unit such that the developing roller is in pressure contact with the image bearing member. The pressing-force adjusting assembly contacts one of the first frame and the developing unit and generates a second pressing force acting on the developing unit against the first pressing force. The second pressing force is smaller than the first pressing force.

25 Claims, 6 Drawing Sheets

(56) References Cited

U.S. PATENT DOCUMENTS

| | | | | |
|---|---|---|---|---|
| 2006/0083544 | A1 | 4/2006 | Okabe | |
| 2006/0159487 | A1 | 7/2006 | Choi et al. | |
| 2007/0160388 | A1* | 7/2007 | Yoshimura et al. | 399/111 |
| 2007/0286639 | A1 | 12/2007 | Murayama | |
| 2008/0063440 | A1* | 3/2008 | Moon | 399/288 |
| 2009/0220273 | A1 | 9/2009 | Tomatsu | |
| 2009/0297214 | A1 | 12/2009 | Chadani et al. | |
| 2011/0150528 | A1 | 6/2011 | Tomatsu | |
| 2012/0163859 | A1 | 6/2012 | Hashimoto et al. | |

FOREIGN PATENT DOCUMENTS

| | | | |
|---|---|---|---|
| CN | 101592912 | A | 12/2009 |
| EP | 0 736 818 | A1 | 10/1996 |
| JP | 01-225974 | A | 9/1989 |
| JP | 05-197221 | A | 8/1993 |
| JP | 08-335023 | A | 12/1996 |
| JP | 09-114238 | A | 5/1997 |
| JP | 2002-091265 | A | 3/2002 |
| JP | 2002-333772 | A | 11/2002 |
| JP | 2005-189777 | | 7/2005 |
| JP | 2006-030505 | A | 2/2006 |
| JP | 2006-091582 | A | 4/2006 |
| JP | 2006-119220 | A | 5/2006 |
| JP | 2007-086424 | A | 4/2007 |
| JP | 2007-232771 | A | 9/2007 |
| JP | 2007-328300 | A | 12/2007 |
| JP | 2009-031700 | | 2/2009 |
| JP | 2009-180987 | | 8/2009 |
| JP | 2009-210631 | | 9/2009 |
| JP | 2009-237591 | A | 10/2009 |
| JP | 2010-231132 | A | 10/2010 |
| JP | 2012-137556 | A | 7/2012 |
| JP | 5206781 | B2 | 6/2013 |

OTHER PUBLICATIONS

Extended European Search Report issued in corresponding European Patent Application No. 11190940.4 dated Jul. 29, 2013.

Office Action issued in Japanese Patent Application No. 2013-029255 mailed Mar. 4, 2014.

* cited by examiner

PROCESS UNIT AND IMAGE-FORMING DEVICE USING PROCESS UNIT

CROSS REFERENCE TO RELATED APPLICATION

This application claims priorities from Japanese Patent Application Nos. 2010-288711 filed Dec. 24, 2010 and 2011-186912 filed Aug. 30, 2011. The entire contents of the priority applications are incorporated herein by reference.

TECHNICAL FIELD

The invention relates to an image-forming device, more specifically, to a developing unit detachably mountable on a photosensitive unit, and a process unit provided with the developing unit and the photosensitive unit.

BACKGROUND

Japanese Patent Application Publication No. 2009-180987, as an conventional example, discloses a process unit is provided with a photosensitive unit having a photosensitive drum, a developing unit having a developing roller for supplying toner to the photosensitive drum, and a coil spring urging the developing unit so as to permit the developing roller to be in pressure contact with the photosensitive drum.

More specifically, the photosensitive unit has a box shaped casing having an upper opening, and the photosensitive drum is provided at one end of the casing, and the coil spring is provided at another end of the casing. Upon assembly of the developing unit with the photosensitive unit, the developing roller is urged by the coil spring with a predetermined force and is brought to pressure contact with the photosensitive drum.

In another conventional example, a process unit is provided with a pressing member configured to press a developing unit including a developing roller toward a photosensitive drum, and a separating member configured to separate the developing roller from the photosensitive drum against a pressing force of the pressing member. In this process unit, the developing roller is in pressure contact with the photosensitive drum with a predetermined nipping pressure due to the pressing force of the pressing member, and the developing unit is held between the photosensitive drum and the pressing member.

SUMMARY

The present inventors recognized that, in the process unit in the above first conventional example, the developing unit assembled to the photosensitive unit may be wobbled if excessive force is exerted on the developing unit. In order to avoid this problem, the developing unit should be mounted more fixedly on the photosensitive unit by using a coil spring having an increased urging force. However, in the latter case, smooth rotation of the developing roller and the photosensitive drum may be inhibited by the increased pressure contact between the developing roller and the photosensitive drum. Further, in the second conventional example, increasing the pressing force of the pressing member to prevent wobbling of the developing unit results in increase in the nipping pressure between the photosensitive drum and the developing roller.

In view of the foregoing, it is an object of the invention to provide a developing unit and a process unit including the developing unit capable of restraining wobbling of a developing roller relative to a photosensitive drum while maintaining a suitable pressing force of the developing roller against the photosensitive drum. It is another object of the invention to provide an image forming device in which the developing roller can be pressed against the photosensitive drum in a balanced manner.

In order to attain the above and other objects, the invention provides a process unit. The process unit includes an image bearing member a first frame, a developing unit, a pressing assembly, and a pressing-force adjusting assembly. The first frame supports the image bearing member. The developing unit includes a developing roller and a second frame supporting the developing roller. The pressing assembly generates a first pressing force acting on the developing unit such that the developing roller is in pressure contact with the image bearing member. The pressing-force adjusting assembly contacts one of the first frame and the developing unit and generates a second pressing force acting on the developing unit against the first pressing force. The second pressing force is smaller than the first pressing force.

According to another aspect, the present invention provides a developing unit. The developing unit includes a developing roller, a frame, a pressed member, and a pressing-force adjusting assembly. The developing roller is configured to contact an image bearing member and provides the image bearing member with developer. The frame rotatably supports the developing roller. The pressed member is pressed toward the image bearing member by a first force. The pressing-force adjusting assembly contacts the image bearing member and generates a second pressing force against the first pressing force. The second pressing force being smaller than the first pressing force.

According to still another aspect, the present invention provides an image-forming device. The image-forming device includes an image bearing member, a first frame, a developing unit, a pressing assembly, and a pressing-force adjusting assembly. The first frame supports the image bearing member. The developing unit includes a developing roller and a second frame supporting the developing roller. The pressing assembly generates a first pressing force acting on the developing unit such that the developing roller is in pressure contact with the image bearing member. The pressing-force adjusting assembly contacts one of the first frame and the developing unit and generates a second pressing force acting on the developing unit against the first pressing force. The second pressing force being smaller than the first pressing force.

DETAILED DESCRIPTION

First, a color printer 1 according to an embodiment of the invention will be described with reference to FIG. 1.

The terms "upward", "downward", "upper", "lower", "above", "below", "beneath", "right", "left", "front", "rear" and the like will be used throughout the description assuming that the color printer 1 is disposed in an orientation in which it is intended to be used. In use, the color printer 1 is disposed as shown in FIG. 1. Specifically, a right side of FIG. 1 will be referred to as a front side, and a left side in FIG. 1 will be referred to as a rear side. A far side in FIG. 1 will be referred to as a right side, and a near side in FIG. 1 will be referred to as a left side.

Figure 1:
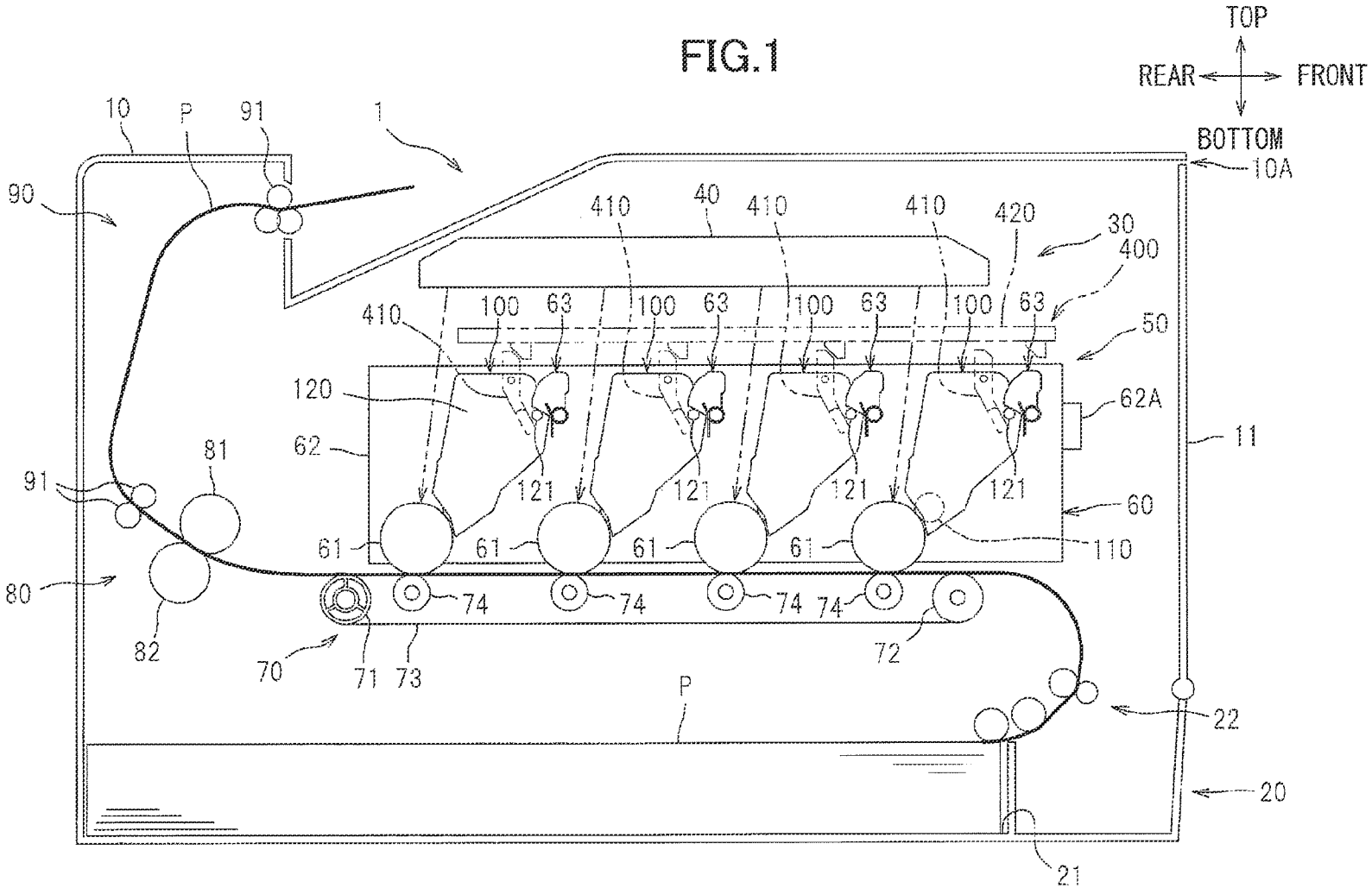
FIG. 1 is a schematic view showing a general configuration of a color printer incorporating a process cartridge according to an embodiment of the invention.

As shown in FIG. 1, the color printer 1 includes a main body 10 provided with a pivotally-movable front cover 11. Within the main body 10, a sheet supplying unit 20, an image forming unit 30 and a sheet discharging unit 90 are disposed.

The sheet supplying unit 20 serves to supply sheets P toward the image forming unit 30. The sheet supplying unit 20 includes a sheet tray 21 in which a plurality of sheets P is accommodated in a stacked state, and a sheet conveying device 22 for conveying the sheet P from the sheet tray 21 toward the image forming unit 30.

The image forming unit 30 forms image on a conveyed sheet P. The image forming unit 30 includes a scanning unit 40, a process unit 50, a transferring unit 70 and a fixing unit 80.

The scanning unit 40 is disposed at an upper portion of the main body 10. The scanning unit 40 includes a laser emitting section, a polygon mirror and a plurality of lenses and reflective mirrors (all not shown). A laser beam emitted from the laser emitting section is irradiated, at a high speed, onto a surface of each photosensitive drum 61 provided in the process unit 50, as indicated by two-dot chain lines in FIG. 1.

The process unit 50 is detachably mountable in the main body 10 through an opening 10A defined by opening the front cover 11. The process unit 50 includes a drawer 60 and four developing cartridges 100 detachably mountable on the drawer 60. The developing cartridge 100.

The drawer 60 includes four photosensitive drums 61 each disposed in correspondence with each developing cartridge 100, and four conventional chargers (not shown) each provided for each photosensitive drum 61.

Each developing cartridge 100 includes a developing roller 110 a toner accommodation chamber and a supply roller (not shown). Specifically, each developing cartridge rotatably supports the developing roller 110. The developing roller 110 contacts and supplies toner to the corresponding photosensitive drum 61 when the developing roller 110 rotates.

The transferring unit 70 is disposed between the sheet supplying unit 20 and the process unit 50 in a vertical direction (a top-to-bottom direction). The transferring unit 70 includes a driver roller 71, a follower roller 72, an endless conveyor belt 73 and four transfer rollers 74.

Inside the endless conveyor belt 73, the driver roller 71 and the follower roller 72 are disposed in separation from each other in a front-to-rear direction. The conveyor belt 73 is supported by the driver roller 71 and the follower roller 72 in a taut state. The conveyor belt 73 has an outer circumferential surface with which each of the photosensitive drums 61 is arranged to be in contact. The conveyor belt 73 has an inner circumferential surface within which each of the transfer rollers 74 is disposed such that each photosensitive drum 61 and each transfer roller 74 can nip the conveyor belt 73 therebetween. Each transfer roller 74 is applied with a transfer bias, under a constant current control, when transferring toner to the sheet P conveyed on and along the conveyor belt 73.

The fixing unit 80 is disposed rearward of the process unit 50 and the transferring unit 70. The fixing unit 80 includes a heat roller 81 and a pressure roller 82 disposed in opposition to the heat roller 81 for pressing the same.

The sheet discharging unit 90 includes a plurality of conveyor rollers 91 for conveying sheet P.

In the color printer 1 having the above-described configuration, the surface of each photosensitive drum 61 is firstly uniformly charged by the corresponding charger. The scanning unit 40 then exposes respective charged surfaces of the photosensitive drums 61 to form an electrostatic latent image thereon based on image data. Each developing roller 110 subsequently supplies toner within the developing cartridge 100 to the electrostatic latent image formed on the corresponding photosensitive drum 61 for developing the latent image into a visible toner image.

The toner image carried on each photosensitive drum 61 is transferred to the sheet P while the sheet P on the conveyor belt 73 passes between the photosensitive drum 61 and the corresponding transfer rollers 74. Subsequently, the toner image is thermally fixed to the sheet P as the sheet P passes between the heat roller 81 and the transfer roller 82. The image-formed sheet P is finally discharged out of the main body 10 by the conveyor rollers 91.

Next, a detailed structure in the vicinity of the process unit 50 will be described with reference to FIGS. 1 through 7B.

Figure 3:
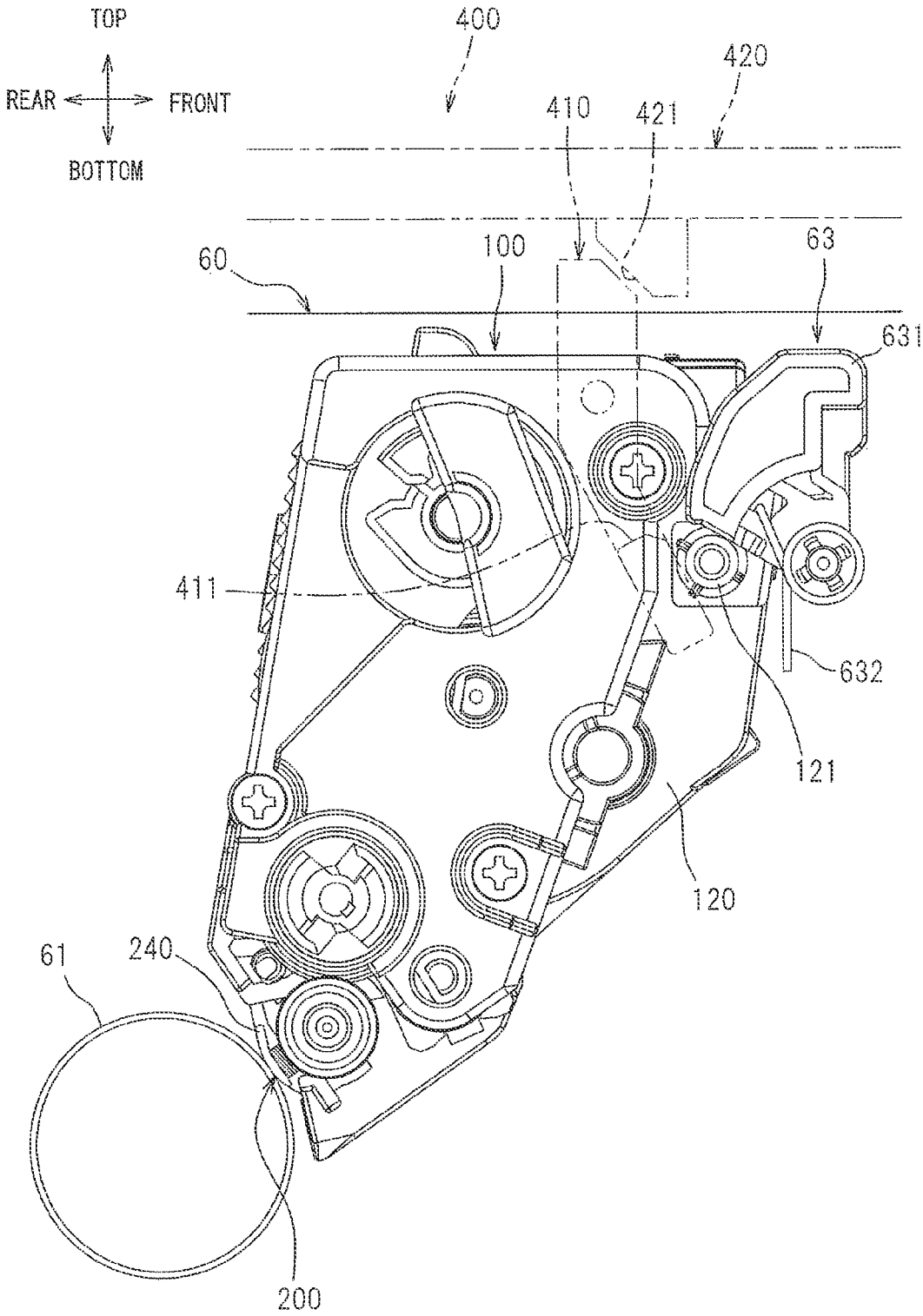
FIG. 3 is a left side view of the process cartridge according to the embodiment, wherein the process cartridge is in pressure contact with a photosensitive drum and a pressing member.

As shown in FIGS. 1 and 3, the process unit 50 includes the drawer 60, four developing cartridges 100 each being detachably mountable in the drawer 60, and a separation mechanism 400 configured to separate each developing cartridge 100 (developing roller 110) within the drawer 60 from the corresponding photosensitive drum 61.

The drawer 60 includes a drawer frame 62 rotatably supporting the four photosensitive drums 61 arrayed in the front-to-rear direction, and pressing assemblies 63 for urging each developing cartridge 100 toward the corresponding photosensitive drum 61.

The drawer frame 62 has a rectangular box shape having a pair of side walls, a front wall and a rear wall with upper and lower open ends. Each side wall has a lower portion supporting the photosensitive drums 61. The front wall has a handgrip 62A protruding frontward so that a user can grip the handgrip 62A to pull out the drawer 60 frontward.

Figure 2:
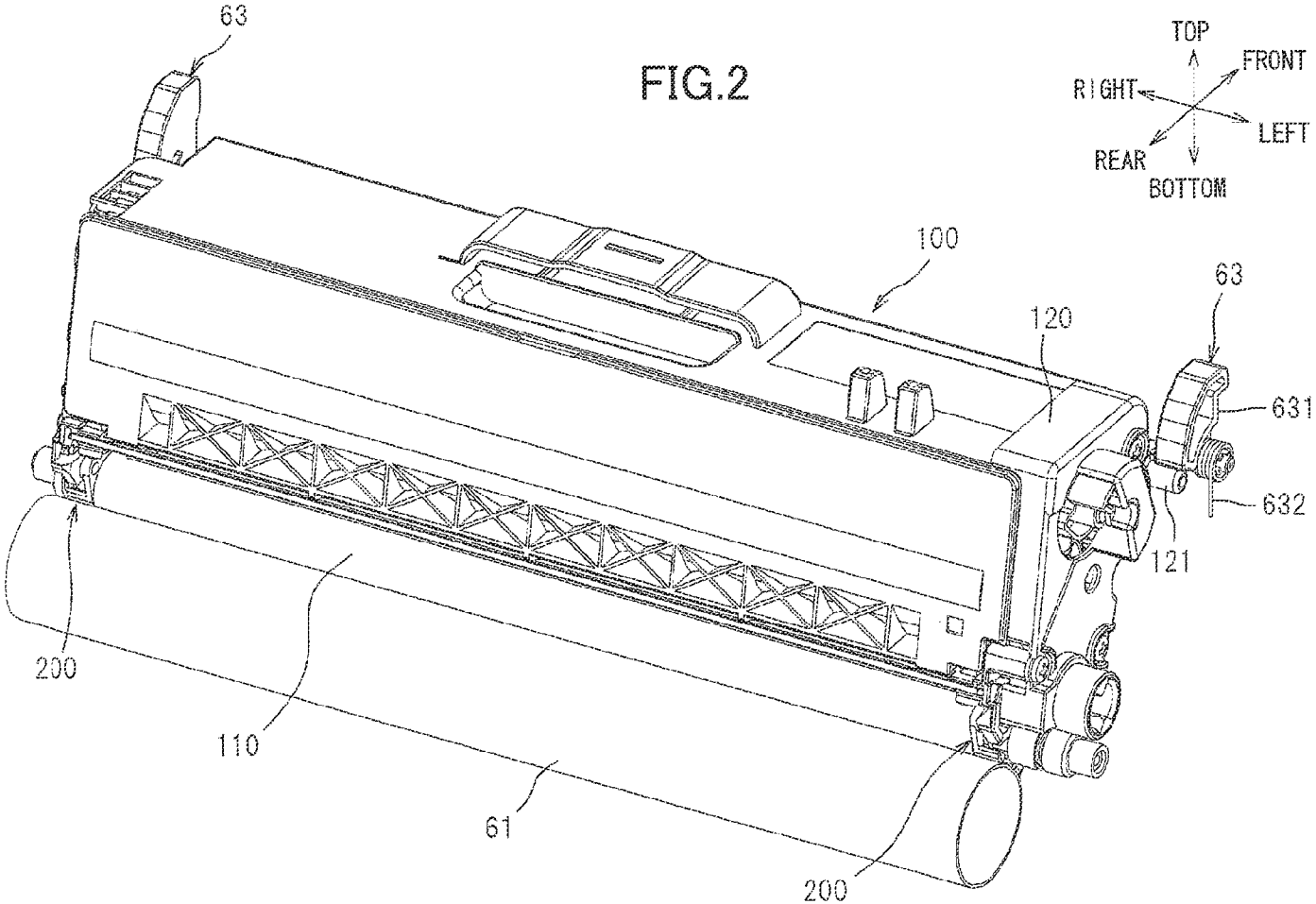
FIG. 2 is a perspective view showing an exterior of the process cartridge according to the embodiment.

As shown in FIGS. 2 and 3, the pressing assembly 63 is adapted to press the developing cartridge 100 rearward and diagonally downward so as to permit the developing roller 110 to pressingly contact with the corresponding photosensitive drum 61. For each developing cartridge 100, a pair of pressing assemblies 63 is provided spaced away from each other at each end portion of each developing cartridge 100 in a left-to-right direction (an axial direction of the developing roller 110). Specifically, the pair of pressing assemblies 63 is disposed at a symmetrical position with respect to a center of each developing cartridge 100 in the left-to-right direction. Further, the pressing assembly 63 is positioned adjacent to and frontward of an upper front corner portion of the developing cartridge 100. With this arrangement, the developing cartridge 100 can be pressed with suitable pressure balance in the left-to-right direction, and accordingly, the developing roller 110 can be pressed against the photosensitive drum 61 uniformly in the left-to-right direction.

Incidentally, each pair of pressing assemblies 63 has a structure identical to each other, and therefore, only one pair of pressing assemblies 63 for one developing cartridge 100 will be described. Further, since the left and right pressing assemblies 63 have structures symmetrical to each other, and therefore, only one of the right and left pressing assemblies 63 will be described.

The pressing assembly 63 includes a lock member 631 pivotally movably supported to the drawer frame 62, and a torsion spring 632 urging the lock member 631 toward the photosensitive drum 61 (toward the developing cartridge 100). The developing cartridge 100 has a developing frame 120 provided with an engagement protrusion 121. As the lock member 631 urged by the torsion spring 632 presses against the engagement protrusion 121, the developing cartridge 100 is pressed toward the photosensitive drum 61.

The developing cartridge 100 has an end portion adjacent to the photosensitive drum 61. At the end portion of each developing cartridge 100 includes a pair of pressing-force adjusting assemblies 200. Each pressing-force adjusting assembly 200 is in contact with the photosensitive drum 61 and adapted to press the developing cartridge 100 against the pressure from the pressing assembly 63 with a pressing force lower than that of the pressing assembly 63. With this structure, even if the pressure from the pressing assembly 63 is increased, the increase in pressure can be canceled by the pressure from the pressing-force adjusting assembly 200. Thus, suitable pressure can be applied from the developing roller 110 to the photosensitive drum 61 and the pressure can be maintained. Further, the developing cartridge 100 can be firmly nipped between the pressing assembly 63 and the pressing-force adjusting assembly 200, thereby firmly holding the developing cartridge 100 to the drawer 60.

The pair of side walls of the drawer frame 62 has a guide groove or a guide rib for guiding movement of the developing cartridge 100 to a position shown in FIG. 3 (between the photosensitive drum 61 and the pressing assembly 63) and to maintain the posture of the developing cartridge 100 as shown in FIG. 3. The developing cartridge 100 guided and held by the guide groove (rib) is also nipped between the pressing assembly 63 and the pressing-force adjusting assembly 200, so that the developing cartridge 100 can be firmly held to the drawer frame 62.

The pressing-force adjusting assembly 200 is provided at each end portion of the developing roller 110 in the left-to-right direction. That is, the two pressing-force adjusting assemblies 200 are disposed spaced away from each other at a symmetrical position with respect to a center of each developing roller 110 in the left-to-right direction. With this arrangement, the photosensitive drum 61 can be pressed by the developing roller 110 with suitable pressure balance in the left-to-right direction.

The pressing force of right and left pressing assemblies 63 may be adjusted or may be different from each other, and further, the pressing force of right and left pressing-force adjusting assemblies 200 may be adjusted or may be different from each other taking a position of a center of gravity of the developing cartridge 100 into consideration.

Each pair of the pressing-force adjusting assemblies 200 has a structure identical to each other, and therefore, only one pair of pressing-force adjusting assemblies 200 for one developing cartridge 100 will be described. Further, since the left and right pressing-force adjusting assemblies 200 have structures symmetrical to each other, only one of the right and left pressing-force adjusting assemblies 200 will be described.

Figure 4:
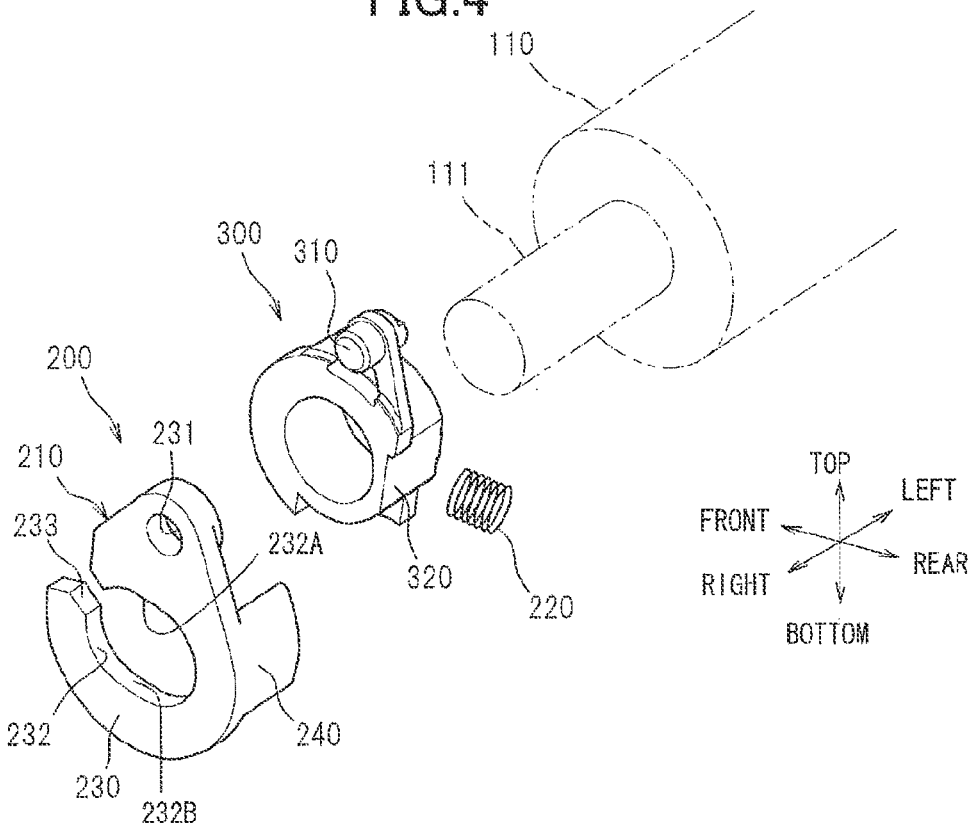
FIG. 4 is an exploded perspective view of a pressing-force adjusting assembly and a bearing member prior to their assembly to a developing roller, the pressing-force adjusting assembly including a pivotally movable member and a coil spring.
Figure 5:
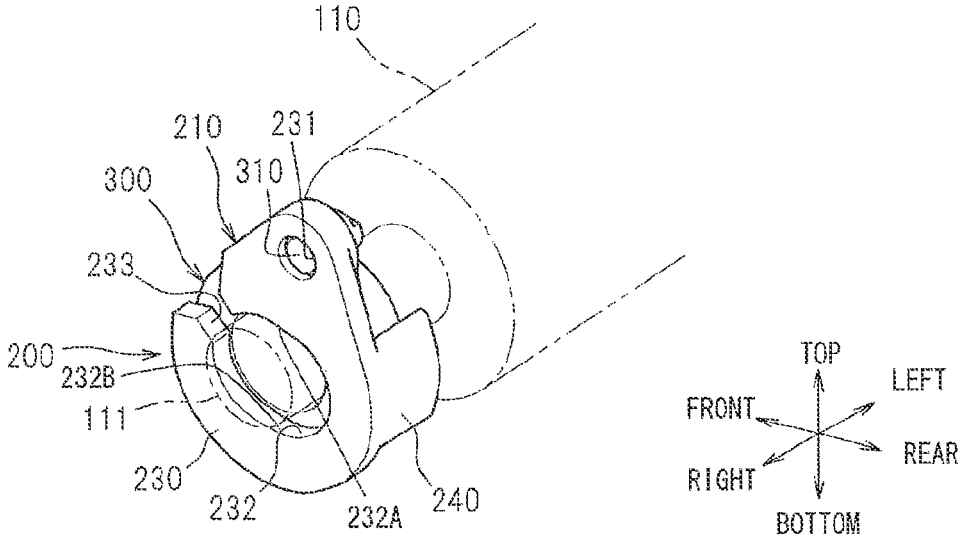
FIG. 5 is a perspective view showing a state where the pressing-force adjusting assembly and the bearing member have been assembled to the developing roller.

As shown in FIGS. 4 and 5, the pressing-force adjusting assembly 200 includes a pivot member 210, and a coil spring 220. The pivot member 210 has a main body portion 230 having generally sector shape whose lower end is formed into an arcuate shape, and a contact portion 240 in contact with the outer peripheral surface of the photosensitive drum 61.

The main body portion 230 has an upper portion formed with a circular engagement hole 231 and a lower portion formed with an oblong slot 232. The engagement hole 231 is adapted to be engaged with a pivot shaft 310 provided at a bearing member 300 described later, so that the main body portion 230 can be pivotally movable about the pivot shaft 310.

More specifically, the main body portion 230 is pivotally movably supported to the pivot shaft 310, such that a lower end portion of the main body portion 230 can be moved in a pressing direction of the pressing assembly 63 (a diagonally downward and rearward direction). In other words, the main body portion 230 is indirectly pivotally movably supported to the developing frame 120 through the bearing member 300.

The bearing member 300 is fixed to the developing frame 120 and rotatably supports a rotation shaft 111 of the developing roller 110. That is, the developing roller 110 and the main body portion 230 are supported to the developing frame 120 through the bearing member 300.

Figure 6A:
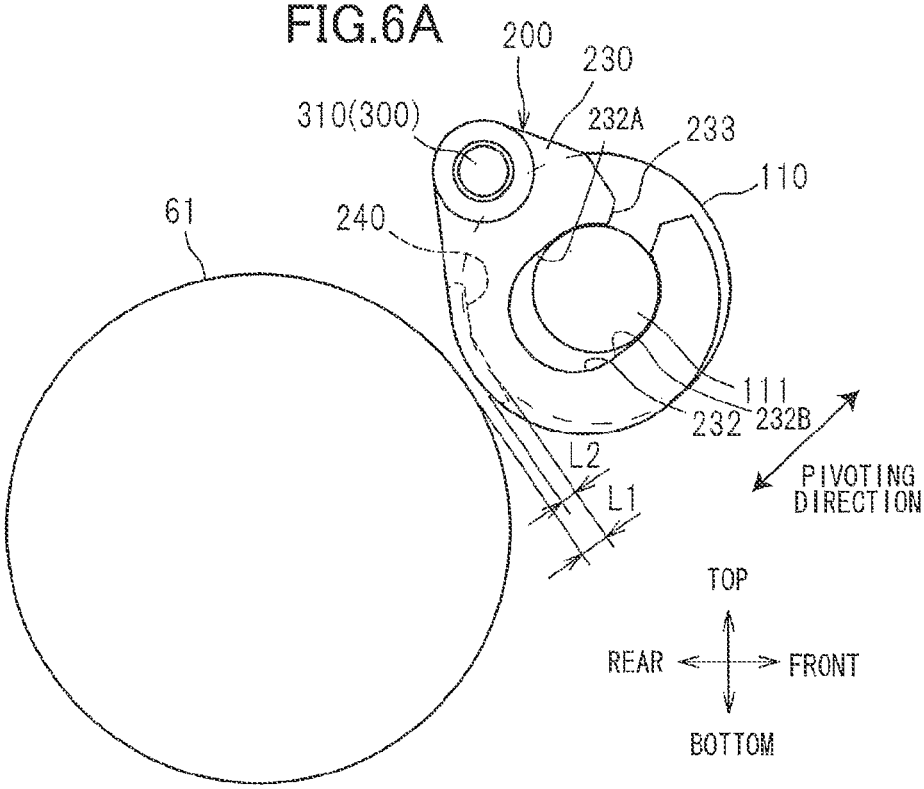
FIG. 6A is a view showing a positional relationship between the pivotally-movable member and the developing roller when the pivotally movable member is in separation from the photosensitive drum.
Figure 6B:
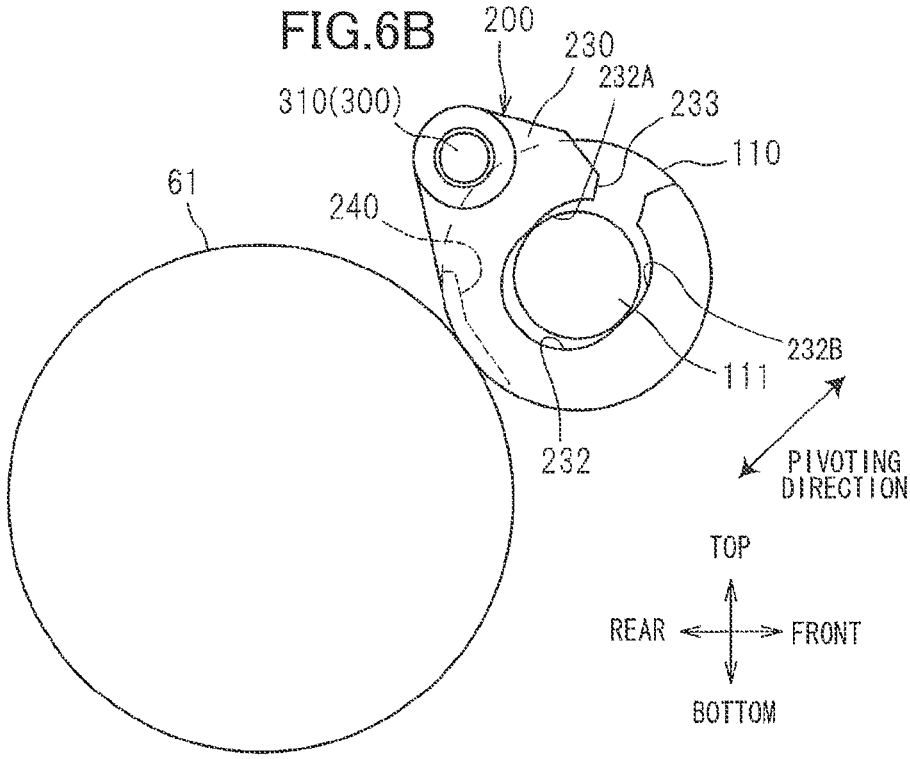
FIG. 6B is a view showing a positional relationship between the pivotally-movable member and the developing roller when the pivotally movable member is in pressure contact with the photosensitive drum.

The oblong slot 232 allows the rotation shaft 111 to pass therethrough. As shown in FIGS. 6A and 6B, the oblong slot 232 has a radially inner side 232A (upper side) and a radially outer side 232B (lower side). The radially inner side 232A and the radially outer side 232B are arcuate whose center of radius is coincident with a diametrical center of the rotation shaft 111 and extend in a pivoting direction of the main body portion 230. The length of the radially inner side 232A and the radially outer side 232B in the pivoting direction are larger than the diameter of the rotational shaft 111 such that the pivot member 210 can pivot in the pivoting direction. The length between the radially inner side 232A and the radially outer sides 232B approximately equal to a diameter of the rotation shaft 111. With this structure, during pivotal motion of the pivot member 210, the inner surface of the oblong slot 232 is constantly supported by the rotation shaft 111, thereby stabilizing pivotal movement of the pivot member 210.

The oblong slot 232 has a rear peripheral end portion and a front end portion (opposite to the contact portion 240) on which a slit 233 is formed. The slit 233 provides a gap smaller than the width of the oblong slot 232 in the direction orthogonal to the pivoting direction such that the oblong slot 232 is open frontward. With this structure, the pivot member 210 can be assembled to the rotation shaft 111 in a radial direction of the rotation shaft 111 through the slit 233, due to resilient deformation of the oblong slot 232, even after the developing roller 110 has been assembled to the developing cartridge 100.

The contact portion 240 protrudes inward in a left-to-right direction from the rear peripheral end portion of the main body 230 (a side facing the photosensitive drum 61). In accordance with pivotal movement of the main body portion 230, the contact portion 240 is pivotally movable in the pressing direction of the pressing assembly 63. The contact portion 240 is formed in a shape substantially in conformance with an outer circumferential surface of the developing roller 110 that is pressed by the photosensitive drum 61. Therefore, the pressing force can be applied from the developing roller 110 and the contact portion 240 to the photosensitive drum 61 in a balanced manner in the axial direction, and the photosensitive drum 61 can rotate smoothly.

Figure 7A:
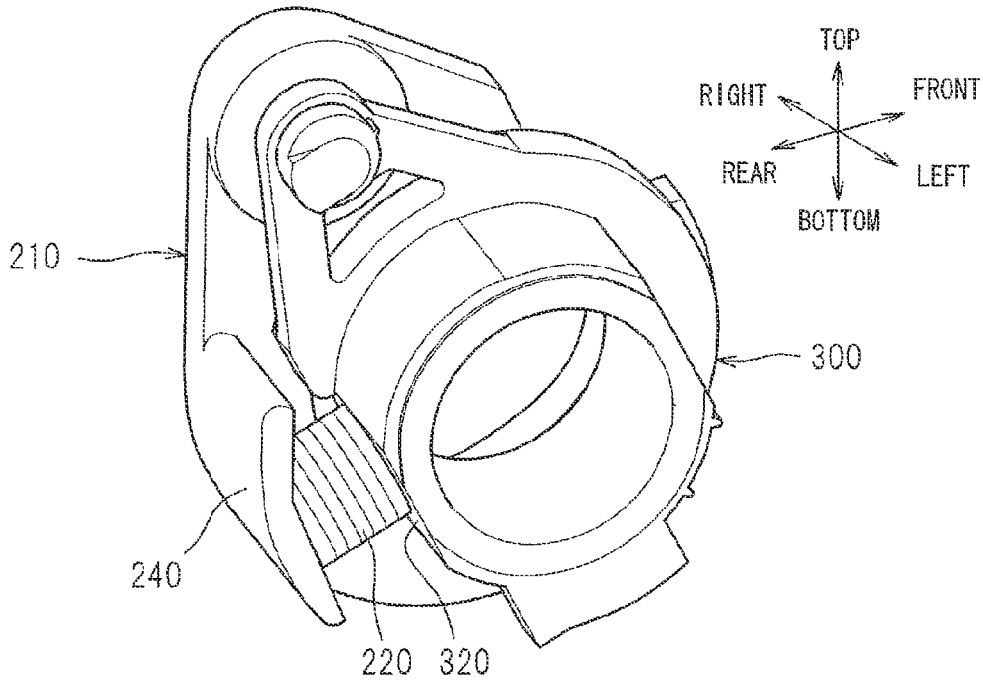
FIG. 7A is a perspective view showing a state of the coil spring when the pivotally-movable member is in separation from the photosensitive drum.
Figure 7B:
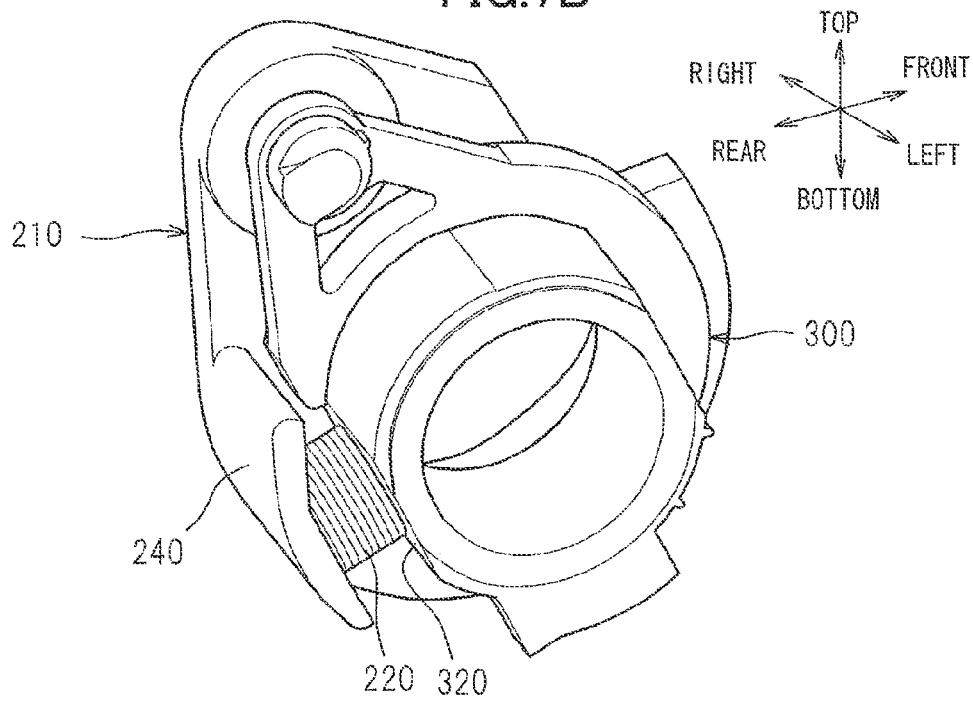
FIG. 7B is a perspective view showing a state of the coil spring when the pivotally-movable member is in pressure contact with the photosensitive drum.

As shown in FIGS. 7A and 7B, the coil spring 220 is disposed between the contact portion 240 and a planer contact surface 320 formed on the bearing member 300 in such a state that the coil spring 220 is at natural length or compressed from its natural length. In other words, since the coil spring 220 has one end supported to the pivot member 210 and another end supported to the developing frame 120 via the bearing member 300, the coil spring 220 is disposed between the pivot member 210 and the developing frame 120. The coil spring 220 may be fixed to either one of the contact portion 240 and the contact surface 320.

In FIGS. 7A and 7B, the coil spring 220 is illustrated in a simplified manner. The compression state of the coil spring 220 is illustrated by changing an interval between neighboring lines each representing the coil spring 220. The coil spring 220 is compressed between the contact portion 240 and the contact surface 320 more tightly after the developing cartridge 100 has been mounted in the drawer 60 (a state shown in FIG. 7B) than before the developing cartridge 100 is mounted in the drawer 60 (a state show in FIG. 7A). Therefore, the coil spring 220 can press (bias) the developing cartridge 100 against the pressing force of the pressing assembly 63 when the developing cartridge 100 has been mounted in the drawer 60.

As shown in FIG. 6A, when the developing cartridge 100 is removed from the drawer 60 (i.e., before the developing cartridge 100 is assembled to the drawer 60, or the contact portion 240 is in separation from the photosensitive drum 61), the coil spring 220 moves (pivots) the contact portion 240 toward the photosensitive drum 61. That is, the contact portion 240 moves toward the photosensitive drum 61 relative to the developing roller 110. In other words, when the developing cartridge 100 is removed from the drawer 60 or when the developing roller 110 is separated from the photosensitive drum 61 by the separation mechanism 400 as shown in FIG. 6A, the contact portion 240 protrudes radially further outward than the photosensitive drum 61 in the radial direction of the rotation shaft 111.

With this construction, when the developing cartridge 100 is detached from the drawer 60, the contact portion 240 is allowed to move by a greater amount (with a greater stroke) compared to a configuration where the contact portion 240 is aligned with the surface of the developing roller 110. Therefore, the coil spring 220 is permitted to deform (contract and expand) by a larger amount, enabling the pressing force from the pressing-force adjusting assembly 200 to be stabilized.

As shown in FIGS. 1 and 3, the separation mechanism 400 acts on the developing cartridge 100 such that the developing roller 110 can be separated from its corresponding photosensitive drum 61 against the pressing force of the pressing assembly 63. The separation mechanism 400 includes four pairs of separating arms 410 and a pair of separating cams 420.

Each pair of separating arms 410 is disposed at both widthwise ends of the developing cartridge 100 in the left-to-right direction. More specifically, each separating arm 410 is pivotally movably disposed on an inner surface of each side wall of the drawer frame 62. Therefore, each separating arm 410 has upper and lower end portions pivotably movable in the front-to-rear direction.

As shown in FIG. 3, the lower end portion of each separating arm 410 is formed with a protruding portion 411 protruding inward therefrom in the left-to-right direction. As the separating arm 410 pivotally moves in a counterclockwise direction in FIG. 3, the protruding portion 411 pushes the engagement protrusion 121 of the developing cartridge 100 diagonally upward and frontward. As a result, the developing cartridge 100 is moved along guide portions (not shown) provided on the drawer 60 such that the developing roller 110 is separated from the corresponding photosensitive drum 61 (see FIG. 6A).

Specifically, the protruding portion 411 of the separating arm 410 is designed to be movable in a direction identical to a direction in which the contact portion 240 of the pressing-force adjusting assembly 200 is movable. Thus, the pressing-force adjusting assembly 200 moves in a direction identical to a direction in which the developing roller 110 moves (the direction in which the separation mechanism 400 separates the developing roller 110 from the photosensitive drum 61). Each separating arm 410 is operated to move in accordance with movement of the separating cam 420.

Each separating cam 420 extends in the front-to-rear direction in which the developing rollers 110 are arranged and is linearly movable in the front-to-rear direction. As the separating cam 420 moves backward, the separating arm 410 (specifically, each of slanted surfaces 421 described below) pushes a portion of the separating arm 410 protruding outward from the upper portion of the separating arm 410 in the left-to-right direction (not shown) such that the separating arm 410 pivotally moves in the counterclockwise direction in FIG. 3. More specifically, each separating cam 420 is disposed on an inner wall of each side wall (left and right side walls) constituting the main body 10 such that the separating cam 420 is movable relative to the corresponding side wall in the front-to-rear direction.

Each separating cam 420 has four slanted surfaces 421 each sloping downward in the front-to-rear direction. Each slanted surface 421 serves to push the corresponding separating arm 410. In the embodiment, four slanted surfaces 421 arranges such that three slanted surfaces 421 contacts and pushes the corresponding three separating arms 410 that correspond to the three developing cartridges 100 accommodating toner for colors other than black when the separating cam 420 moves backward a predetermined length, and such that one slanted surface 421 contacts the corresponding separation arm 410 that correspond to the developing cartridge 100 accommodating black toner when the separating cam 420 further moves backward from a position where three slanted surfaces 421 contacts the corresponding three separation arms 410. That is, when three slanted surfaces 421 contacts and pushes the corresponding three separation arm 410, three developing roller 110 corresponding to colors other than black are separated from the corresponding three photosensitive drum 61 and only one developing roller 110 corresponding to the black color contacts the photosensitive drum 61, and, thus, the monochrome image can be printed. This configuration enables the color printer 1 to switch its printing mode between a color mode and a monochrome mode.

The separating cam 420 is configured to be movable in the front-to-rear direction by a drive mechanism (not shown) disposed within the main body 10. This drive mechanism may be configured of a motor and gears. Or another mechanism that enables the separating cam 420 to move in the front-to-rear direction in conjunction with opening and closing movement of the front cover 11 may also be employed as the drive mechanism.

Referring to FIG. 6A, the pressing-force adjusting assembly 200 is configured such that, when the separation mechanism 400 functions to separate the developing roller 110 from its corresponding photosensitive drum 61, an amount L1 by which the developing roller 110 moves relative to the photosensitive drum 61 is set to be greater than an amount L2 by which the pressing-force adjusting assembly 200 moves relative to the photosensitive drum 61. That is, an amount of movement of the separating cam 420, an amount of pivotal movement of the separating arm 410, and an amount of stroke of the pressing-force adjusting assembly 200 are so set to satisfy the above relationship between the amount of movement L1 of the developing roller 110 and the amount of movement L2 of the pressing-force adjusting assembly 200 (L1>L2). In other words, prior to assembly of the developing frame 120 to the drawer frame 62 (prior to the developing frame 120 is mounted on the drawer frame 62), the contact portion 240 protrudes radially outwardly from the developing roller 110.

In a conceivable case where the pressing-force adjusting assembly 200 is kept in contact with the photosensitive drum 61 even when the developing roller 110 is separated from the photosensitive drum 61 by the separation mechanism, conceivably the developing cartridge 100 would not move smoothly when the developing roller 110 is brought into contact with the photosensitive drum 61 next time, due to the pressing force of the pressing-force adjusting assembly 200 acting against the pressing assembly 63. Such defect in the developing cartridge 100 may lead to tilting of the developing cartridge 100, which may cause imbalanced pressure contact between the developing roller 110 and the photosensitive drum 61. Consequently, some toner may not be transferred from the developing roller 110 to the photosensitive drum 61.

However, with the configuration according to the embodiment, even if the pressing-force adjusting assembly 200 moves toward the photosensitive drum 61 when the separation mechanism 400 functions to separate the developing roller 110 from the photosensitive drum 61, the pressing-force adjusting assembly 200 can be reliably separated from the photosensitive drum 61 since the amount of movement L1 of the developing roller 110 is greater than the amount of movement L2 of the pressing-force adjusting assembly 200. When the developing cartridge 100 starts to be brought back to the state shown in FIG. 6B (pressure-contact state) from the state shown in FIG. 6A (separated state), the movement of the developing cartridge 100 is not disturbed by the pressing force of the pressing-force adjusting assembly 200 acting against the pressing force of the pressing assembly 63. The developing cartridge 100 can be smoothly brought back to be in pressure contact with the photosensitive drum 61 against a frictional force generated between the developing cartridge 100 and the guide portions (not shown) of the drawer 60. As a result, the developing roller 110 can be pressed against the photosensitive drum 61 with suitable pressure balance in the lateral direction, thereby enabling toner to be reliably transferred from the developing roller 110 to the photosensitive drum 61.

Further, since the protruding portion 411 of the separating arm 410 is designed to be movable in a direction identical to a direction in which the contact portion 240 of the pressing-force adjusting assembly 200 is movable, the pressing-force adjusting assembly 200 can move in a direction identical to a direction in which the developing roller 110 moves (the direction in which the separation mechanism 400 separates the developing roller 110 from the photosensitive drum 61). With this configuration, the amount of movement L1 of the developing roller 110 required to separate the pressing-force adjusting assembly 200 from the photosensitive drum 61 can be made smaller compared to a configuration where the pressing-force adjusting assembly 200 and the developing roller 110 are configured to move in directions different from each other.

As described above, since the increase in the pressing force of the pressing assembly 63 can be cancelled due to the pressing force of the pressing-force adjusting assembly 200, the pressing force of the developing roller 110 relative to the photosensitive drum 61 can be maintained suitably. Further, the developing cartridge 100 can be firmly nipped between the pressing assembly 63 and the pressing-force adjusting assembly 200, thereby restraining wobbling of the developing cartridge 100 relative to the drawer 60.

Further, the pressing-force adjusting assembly 200 is configured of the pivot member 210 and the coil spring 220. Compared to a case where the pressing-force adjusting assembly 200 is configured only of the coil spring 220, the construction of the embodiment allows a greater degree of freedom in designing the shape of the pivot member 210 that is brought into contact with the photosensitive drum 61. The shape of the contact portion 240 according to the embodiment, which is substantially in conformance with the outer circumferential surface of the photosensitive drum 61, enables the photosensitive drum 61 to rotate smoothly.

Further, the coil spring 220 is disposed between the pivot member 210 and the bearing member 300 in the embodiment. Compared to a configuration where the bearing member 300 is not provided and the coil spring 220 is in direct contact with the rotation shaft 111 of the developing roller 110, abrasion of the coil spring 220 attributed to sliding contact with the rotation shaft 111 of the developing roller 110 can be suppressed.

When the developing cartridge 100 is removed from the drawer 60, the contact portion 240 can protrude more closely to the photosensitive drum 61 than the developing roller 110 to the photosensitive drum 61 in the embodiment. Therefore, the contact portion 240 can move with a greater stroke, leading to stabilization of the pressing force of the pressing-force adjusting assembly 200.

Further, during pivotal movement of the pivot member 210, the inner surface of the oblong slot 232 is constantly supported by the rotation shaft 111 of the developing roller 110. The pivotal movement of the pivot member 210 can therefore be stabilized.

Further, the pivot member 210 (contacting member) is pivotally movable relative to the developing cartridge 100 in the embodiment. Therefore, the pivot member 210 can move smoothly, compared to a configuration that the contacting member is linearly movable and slidable (sliding movement of the contacting member is guided by a smaller contact surface and is therefore easy to get stuck on the contact surface).

Each pressing-force adjusting assembly 200 is disposed respectively at each end portion of the developing roller 110 in the left-to-right direction. With this arrangement, the photosensitive drum 61 can be pressed by the developing roller 110 with suitable pressure balance in the left-to-right direction.

Further, the pressing assembly 63 is provided at each end portion of the drawer frame 62 in the left-to-right direction (i.e., end portion of the developing roller 110). With this arrangement, imbalance in the pressing force of the developing roller 110 in the left-to-right direction can be prevented.

Further, each developing cartridge 100 is pressed at four points: by the pair of left and right pressing assemblies 63 which are symmetrically positioned in the left-to-right direction, and by the pair of left and right pressing-force adjusting assemblies 200 which are also symmetrically positioned in the left-to-right direction. Therefore, the developing cartridge 100 can be pressed in a balanced manner in the left-to-right direction.

While the invention has been described in detail with reference to the embodiments thereof, it would be apparent to those skilled in the art that various changes and modifications may be made therein without departing from the scope of the invention.

The photosensitive drum 61 is contacted by the pressing-force adjusting assembly 200 in the embodiment. However, a member may be separately or integrally provided with the drawer frame 62, for example, a bearing member configured to rotatably support the photosensitive drum 61, and this member may be contacted by the pressing-force adjusting assembly 200. In case that the pressing-force adjusting assembly 200 is disposed on the drawer frame 62 as will described later, a member may be separately or integrally provided on the developing frame 120, for example, a bearing member rotatably supporting the developing roller 110, and this member may be contacted by the pressing-force adjusting assembly 200. It should be noted, however, that when the photosensitive drum 61 is contacted by the pressing force adjusting assembly 200 in present embodiment, the pressing-force adjusting assembly 200 may be brought into direct contact with the photosensitive drum 61 and therefore the pressing force of the pressing-force adjusting assembly 200 relative to the photosensitive drum 61 can be adjusted with greater accuracy.

In the embodiment, the drawer 60 supports the plurality of photosensitive drums 61 and the plurality of developing cartridges 100 can be detachably mountable on the drawer 60. However, instead of the drawer 60, a plurality of cartridges may be provided. In this case, each cartridge may include one photosensitive drum 61 and one developing cartridge may be detachably mountable on the drum cartridge.

Further, in the embodiment, the developing cartridge 100 integrally includes the developing roller 110 and the toner accommodating chamber. However, a toner cartridge having the toner accommodating chamber may be separated from a developing device including the developing roller. In this case, the developing device may serve as the developing unit.

Although the developing cartridge 100 of the embodiment is configured to be detachably mountable on the drawer frame 62, the invention may be applied to a developing cartridge that cannot be detached from a drawer frame without using a tool such as screw driver.

Instead of the photosensitive drum 61, a belt-like photosensitive member may also be employed.

Further, the pressing assembly 63 and the pressing-force adjusting assembly 200 are respectively configured of two components in the embodiment, but each assembly may be configured solely of a coil spring or a leaf spring. Further, contrary to the embodiment, the pressing assembly 63 may be provided on the developing cartridge 100, while the pressing-force adjusting assembly 200 may be provided on the drawer frame 62.

The pressing assembly 63 of the embodiment is disposed on the drawer 60 such that each pressing assembly 63 is positioned at each widthwise end portion of the developing cartridge 100 in the left-to-right direction. However, only one pressing assembly may be disposed at a position center of each developing cartridge 100 in the left-to-right direction, or more than three pressing assemblies may be provided at symmetrical positions with respect to the center of each developing cartridge 100 in the left-to-right direction. Likewise, the number and the position of the pressing force-adjusting assemblies 200 are not limited to the embodiment. For example, only one pressing-force adjusting assembly 200 may be disposed at one end portion of the developing roller 110 in the left-to-right direction, or two pressing-force adjusting assemblies 200 may be provided on each widthwise end portion of the developing roller 110 in the left-to-right direction.

The separation mechanism 400 of the embodiment is configured of the separating arms 410 and the separating cams 420, but a separation mechanism having another configuration may be employed. For example, a slide member configured to linearly move in the pressing direction of the pressing assembly 63 to press the developing cartridge 100 may be employed as the separation mechanism 400.

The pivot member 210 pivotally moves and contacts the photosensitive drum 61. However, instead, a slide member linearly movable may contacts the photosensitive drum 61. Further, instead of the pivot member 210 supported by the bearing member 300 as in the embodiment, the pivot member 210 may be directly supported to the developing frame 120 without interposing the bearing member 300.

Instead of the coil spring 220 of the embodiment, a torsion spring or a leaf spring may be employed to press (bias) the developing cartridge 100. Further, the coil spring 220 is disposed between the contact portion 240 (contacting member) and the bearing member 300 (bearing member) in the embodiment, but the coil spring 220 may be disposed between the pivot member 210 (a member that contacts the photosensitive drum 61) and the developing roller 110 (rotation shaft 111).

In the embodiment, the oblong slot 232 is formed in the pivot member 210 for allowing the rotation shaft 111 of the developing roller 110 to penetrate therethrough, but the a groove having an arcuate shape identical to that of the oblong slot 232 may be formed on the pivot member 210 instead of the oblong slot 232. This groove is adapted to be engaged with each widthwise end of the rotation shaft 111 of the developing roller 110. In this case as well, the rotation shaft 111 of the developing roller 110 can be constantly rotationally supported to the grooves so that the pivot member 210 can rotate stably and reliably.

The invention is applied to the color printer 1 in the embodiment, but the invention may also be applicable to other types of image forming apparatus, such as a monochrome printer, copier, and multifunction device.

What is claimed is:

1. A process unit comprising:

an image bearing member;

a first frame supporting the image bearing member;

a developing unit that includes a developing roller and a second frame supporting the developing roller;

a pressing assembly including a first elastic member configured to generate a first pressing force acting on the developing unit such that the developing roller is in pressure contact with the image bearing member; and a pressing-force adjusting assembly including a second elastic member configured to generate a second pressing force acting on the developing unit against the first pressing force, the second pressing force being smaller than the first pressing force, wherein the pressing-force adjusting assembly contacts the image bearing member and generates the second pressing force acting on the developing unit against the first pressing force.

2. The process unit according to claim 1, wherein the pressing-force adjusting assembly includes a contact member contacting the image bearing member and supported to the second frame, movable in a first direction in which the developing roller presses the image bearing member, wherein the second elastic member is configured to urge the developing roller against the first pressing force.

3. The process unit according to claim 2, wherein the second elastic member is disposed between the contact member and the developing roller.

4. The process unit according to claim 2, wherein the second elastic member is disposed between the contact member and the second frame.

5. The process unit according to claim 4, wherein the second frame includes a bearing member that rotatably supports the developing roller, the second elastic member being disposed between the contact member and the bearing member.

6. The process unit according to claim 2, wherein prior to assembly of the second frame to the first frame, the contact member protrudes radially outwardly from the developing roller.

7. The process unit according to claim 2, wherein the contact member has one of a through-hole and a groove extending in the first direction, the developing roller having a rotation shaft engaging with one of the through-hole and the groove.

8. The process unit according to claim 2, wherein the second frame pivotally supports the contact member.

9. The process unit according to claim 1, wherein the developing roller is provided with a rotational shaft having one end and another end, wherein the pressing-force adjusting assembly includes two pressing-force adjusting assemblies, a first of the two pressing-force adjusting assemblies disposed at the one end and a second of the two pressing-force adjusting assemblies being disposed at the another end.

10. The process unit according to claim 1, wherein the developing roller is provided with a rotational shaft having one end and another end, wherein the pressing assembly includes two pressing assemblies, a first of the two pressing assemblies disposed at the one end and a second of the two pressing assemblies disposed at the another end.

11. The process unit according to claim 1, wherein the first elastic member includes a spring.

12. The process unit according to claim 1, wherein the second elastic member includes a spring.

13. An image-forming device comprising:

an image bearing member;

a first frame that supports the image bearing member;

a developing unit that includes a developing roller and a second frame supporting the developing roller;

a pressing assembly including a first elastic member configured to generate a first pressing force acting on the developing unit such that the developing roller is in pressure contact with the image bearing member;

a pressing-force adjusting assembly including a second elastic member configured to generate a second pressing force acting on the developing unit against the first pressing force, the second pressing force being smaller than the first pressing force; and a separation portion that moves and separates the developing roller from the image bearing member against the first pressing force by a first moving amount, wherein the pressing-force adjusting assembly contacts the developing unit, and wherein the pressing-force adjusting assembly moves from the image bearing member by a second moving amount when the separation portion moves the developing roller by the first moving amount, the first moving amount being larger than the second moving amount.

14. The image-forming device according to claim 13, wherein the pressing-force adjusting assembly moves in a direction in which the developing roller moves.

15. The image-forming device according to claim 14, wherein the developing roller is provided with a rotational shaft having one end and another end, wherein the pressing-force adjusting assembly includes two pressing-force adjusting assemblies, a first of the two pressing-force adjusting assemblies disposed at the one end and a second of the two pressing-force adjusting assemblies being disposed at the another end.

16. The image-forming device according to claim 14, wherein the developing roller is provided with a rotational shaft having one end and another end, wherein the pressing assembly includes two pressing assemblies, a first of the two pressing assemblies disposed at the one end and a second of the two pressing assemblies disposed at the another end.

17. The image-forming device according to claim 13, wherein the pressing-force adjusting assembly includes a contact member contacting the image bearing member and supported to the second frame, movable in a first direction in which the developing roller presses the image bearing member, wherein the second elastic member is configured to urge the developing roller against the first pressing force.

18. The image-forming device according to claim 17, wherein the second elastic member is disposed between the contact member and the developing roller.

19. The image-forming device according to claim 17, wherein the second elastic member is disposed between the contact member and the second frame.

20. The image-forming device according to claim 19, wherein the second frame includes a bearing member that rotatably supports the developing roller, the second elastic member being disposed between the contact member and the bearing member.

21. The image-forming device according to claim 17, wherein prior to assembly of the second frame to the first frame, the contact member protrudes radially outwardly from the developing roller.

22. The image-forming device according to claim 17, wherein the contact member has one of a through-hole and a groove extending in the first direction, the developing roller having a rotation shaft engaging with one of the through-hole and the groove.

23. The image-forming device according to claim 17, wherein the second frame pivotally supports the contact member.

24. The image-forming device according to claim 13, wherein the first elastic member includes a spring.

25. The image-forming device according to claim 13, wherein the second elastic member includes a spring.

* * * * *